US008915460B2

(12) United States Patent
Büsch et al.

(10) Patent No.: US 8,915,460 B2
(45) Date of Patent: Dec. 23, 2014

(54) DEVICE FOR FEEDING A QUASI-ENDLESS MATERIAL WEB

(75) Inventors: Martin Büsch, Efringen-Kirchen (DE); Tobias Buss, Kandern-Sitzenkirch (DE)

(73) Assignee: A. Raymond et Cie, Grenoble (FR)

( * ) Notice: Subject to any disclaimer, the term of this patent is extended or adjusted under 35 U.S.C. 154(b) by 574 days.

(21) Appl. No.: 13/201,132

(22) PCT Filed: Apr. 9, 2010

(86) PCT No.: PCT/EP2010/002209

§ 371 (c)(1),
(2), (4) Date: Aug. 11, 2011

(87) PCT Pub. No.: WO2010/127755

PCT Pub. Date: Nov. 11, 2010

(65) Prior Publication Data

US 2012/0037679 A1 Feb. 16, 2012

(30) Foreign Application Priority Data

May 6, 2009 (DE) ..... 10 2009 020 065

(51) Int. Cl.
*B65H 23/06* (2006.01)
*B65H 23/185* (2006.01)
*B65H 23/198* (2006.01)

(52) U.S. Cl.
CPC ..... *B65H 23/063* (2013.01); *B65H 23/185* (2013.01); *B65H 23/198* (2013.01); *B65H 2701/1942* (2013.01); *B65H 2801/51* (2013.01)
USPC ..... 242/420.3; 242/418.1

(58) Field of Classification Search
CPC .. B65H 23/06; B65H 23/063; B65H 23/1825; B65H 23/185; B65H 23/1955; B65H 13/198
USPC ..... 242/413, 413.3, 413.4, 413.5, 418.1, 242/420, 420.3
See application file for complete search history.

(56) References Cited

U.S. PATENT DOCUMENTS 2,959,369 A * 11/1960 House ..... 242/334.6
3,232,546 A * 2/1966 Ferrand et al. ..... 242/413.3

(Continued)

FOREIGN PATENT DOCUMENTS

DE 1106542 B 5/1961
DE 1246344 B 8/1967

(Continued)

OTHER PUBLICATIONS

The International Search Report and Written Opinion mailed Jul. 14, 2010 in the parent International application No. PCT/EP2010/002209.

*Primary Examiner* — William A Rivera

(74) *Attorney, Agent, or Firm* — Faegre Baker Daniels LLP

(57) ABSTRACT

The invention relates to a device for feeding a quasi-endless material web (4) to a manipulation device (19) receiving the material web (4), wherein a feed tension unit (8) is provided, through which the material web (4) is fed in an S-shape. The feed tension unit (8) comprises a pivotal feed dancer roller (12), the angle positions thereof being captured by a feed angle sensor (34) and fed to a control unit (36), by means of which the material web (4) is fed or retracted by a dispenser roller motor (3) in the direction of the manipulation device (19), depending on the deviation of the angle position from a reference angle position. Substantially uniform tension in the material web (4) is thereby ensured, even under extreme operating conditions.

10 Claims, 5 Drawing Sheets

(56) References Cited

U.S. PATENT DOCUMENTS

| | | | | | |
|---|---|---|---|---|---|
| 3,697,016 | A | * | 10/1972 | Leifer et al. | 242/412.2 |
| 3,941,332 | A | * | 3/1976 | Matula | 242/413.5 |
| 4,129,238 | A | * | 12/1978 | Herd | 226/29 |
| 4,151,594 | A | * | 4/1979 | Stern | 242/421.1 |
| 4,436,251 | A | * | 3/1984 | Deyesso et al. | 242/412.3 |
| 5,256,239 | A | | 10/1993 | Voltmer et al. | |
| 5,791,541 | A | * | 8/1998 | Jitsuishi et al. | 226/40 |
| 6,067,778 | A | * | 5/2000 | Yamamoto et al. | 53/451 |
| 6,098,442 | A | | 8/2000 | Walldorf et al. | |
| 6,352,751 | B1 | | 3/2002 | Miles et al. | |
| 6,383,591 | B1 | | 5/2002 | Miles et al. | |
| 6,773,539 | B2 | | 8/2004 | Mertens et al. | |
| 8,720,812 | B2 | * | 5/2014 | Liu et al. | 242/412.2 |
| 2004/0180170 | A1 | | 9/2004 | Mertens et al. | |

FOREIGN PATENT DOCUMENTS

| | | | |
|---|---|---|---|
| DE | 4213485 | A1 | 11/1992 |
| DE | 19520955 | A1 | 12/1996 |
| DE | 69708094 | T2 | 4/2002 |
| GB | 890918 | A | 3/1962 |

* cited by examiner

DEVICE FOR FEEDING A QUASI-ENDLESS MATERIAL WEB

CROSS-REFERENCE TO RELATED APPLICATION

This application is a U.S. National Phase patent application based on International Application Serial No. PCT/EP2010/002209 filed Apr. 9, 2010, the disclosure of which is hereby explicitly incorporated by reference herein.

BACKGROUND OF THE INVENTION

1. Field of the Invention

The invention relates to a device for feeding a quasi-endless material web.

2. Description of the Related Art

Devices for feeding a quasi-endless material web, such as according to DE 12 46 344 A, frequently have a pivoted dispenser roll and a feed tension unit which is equipped with a swivel-mounted floating roll. The swivel-mounted dispenser roll, held under tension by a helical tension spring, is used to give the material web a predetermined tensile stress by means of the helical tension spring. This approach had proven useful under operating conditions with a tensile load of the material web that does not fluctuate greatly.

SUMMARY OF THE INVENTION

The present invention provides a device for feeding a quasi-endless material web to a manipulation device receiving the material web, which operates very reliably even with very non-uniform tensile loads of the material web.

Even relatively strong changes in the tensile stress of the material web, caused by relatively quick, extensive movements of the manipulation device, for example, and the securing of the functionality of the device can be balanced quasi-instantaneously because in the device according to the invention the dispenser roll, controlled by the control unit, is triggered via the dispenser roll motor to add or remove material web to or from the manipulation device via the angle sensor detecting the angular position of the dispenser roll when certain angular peripheral positions of the floating roll are reached or exceeded and thus the change range of the tensile loads of the material web that can be buffered by the pivotable floating roll is left.

Based on the following explanation of an exemplary embodiment of the invention with reference to the figures of the drawing, further expedient embodiments and advantages are shown.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
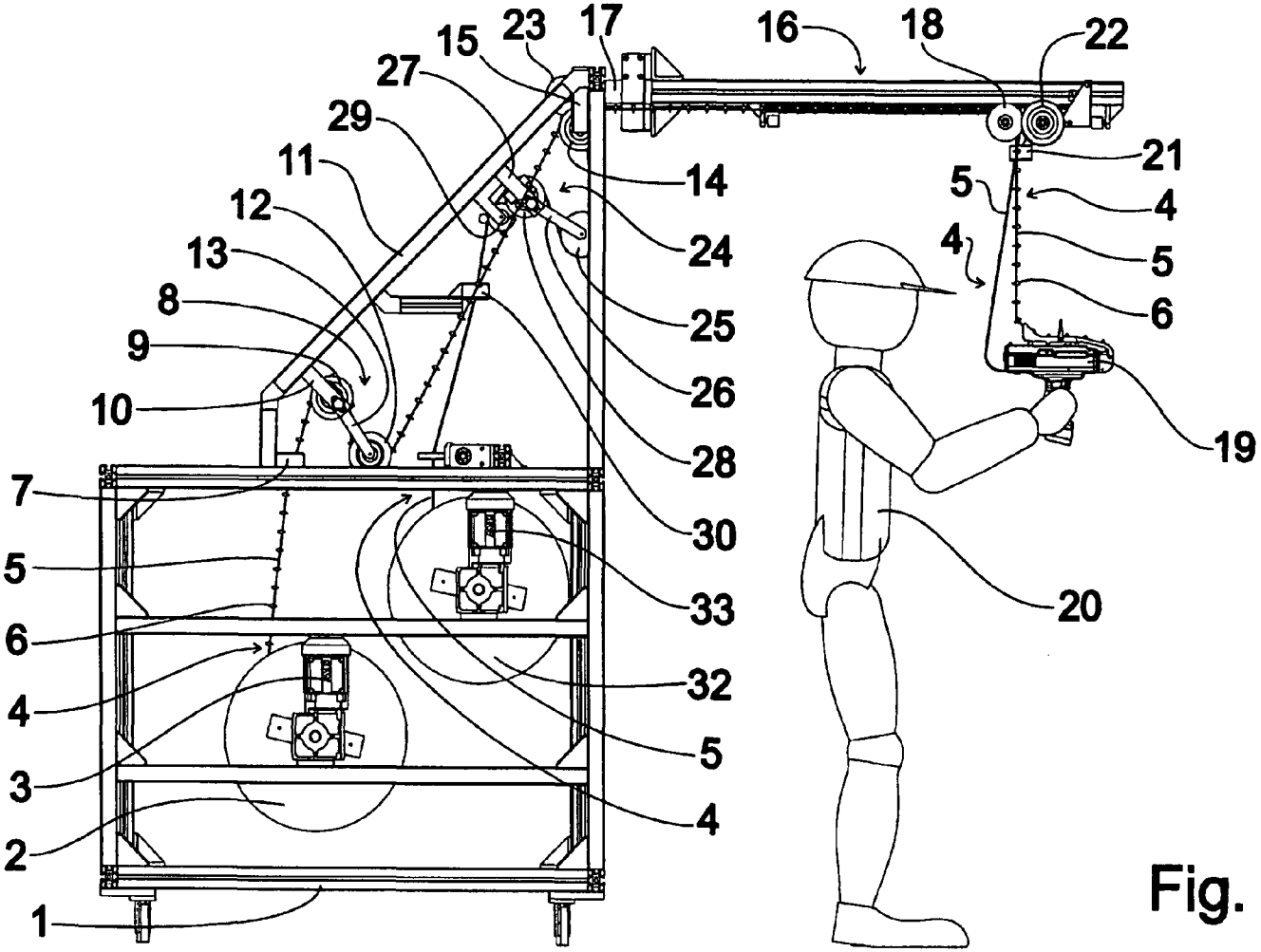
FIG. 1 is a side view of an exemplary embodiment of a device according to the invention.

Corresponding reference characters indicate corresponding parts throughout the several views. Although the exemplifications set out herein illustrate embodiments of the invention, in several forms, the embodiments disclosed below are not intended to be exhaustive or to be construed as limiting the scope of the invention to the precise forms disclosed.

DETAILED DESCRIPTION

FIG. 1 shows an exemplary embodiment of a device according to the invention in a side view. The exemplary embodiment according to FIG. 1 has a rigid, torsionally stiff supporting frame 1, on which a dispenser roll 2 is rotatably supported. The dispenser roll 2 can be driven to rotate in two directions of rotation via a dispenser roll motor 3.

On the dispenser roll 2 a quasi-endless material web 4 is stored, which in this exemplary embodiment is formed by two conveyor belts 5 arranged at a distance parallel to one another with mounting elements 6 attached at regular intervals between the conveyor belts 5.

The material web 4 is fed in a conveyor direction after the dispenser roll 2 through a guide sleeve 7 to a feed tension unit 8 of the device according to the invention. The feed tension unit 8 in this exemplary embodiment has an inlet-side fixed feed roll 9 as a first fixed roll, which is attached rigidly and rotatably to an ascending support bar 11 facing away from the dispenser roll 2. Furthermore, the feed tension unit 8 has a floating feed roll 12 as a floating roll, which is pivotable via a floating feed roll supporting arm 13 with respect to the inlet fixed roll supporting arm 10. Furthermore, the feed tension unit 8 is equipped with an outlet-side fixed feed roll 14, which on the side of the floating feed roll 12 facing away from the inlet-side fixed feed roll 9 as a second fixed roll is connected via an inlet fixed roll supporting arm 15 to the support bar 11 in a rigid and rotatable manner.

It is discernible from FIG. 1 that the material web 4, after passing through the guide sleeve 7, is placed in an S-shaped manner around the inlet-side fixed feed roll 9, the floating feed roll 12 and the outlet-side fixed feed roll 14.

Furthermore, the exemplary embodiment of a device according to the invention according to FIG. 1 has a swivel arm 16 projecting from the supporting frame 1 and, with arrangement of the device as directed, aligned horizontally, which via a rocker pivot 17 with use as directed can be pivoted in the horizontal with respect to the supporting frame 1. On the end of the swivel arm 16 facing away in front of the supporting frame 1, a rotatable feed deflection roll 18 is attached, via which the material web 4 can be fed to a manipulation device 19.

With the manipulation device 19, which in this exemplary embodiment is embodied in the form of a setting gun for the mounting elements 6, the mounting elements 6 can be mounted by a worker 20, for example, on a motor vehicle not shown in FIG. 1. After the assembly operation, the material web 4 is released from the mounting elements 6 and has only the two conveyor belts 5, which emerge from the manipulation device 19.

This part of the material web 4 passes through a further guide sleeve 21, which is attached to the end of the swivel arm 16 facing away from the supporting frame 1 and wraps around a further discharge deflection roll 22, via which the material web 4 can be fed to the supporting frame 1 again.

On the end of the support bar 11 facing towards the swivel arm 16, an inlet-side fixed discharge roll 23 is fed as a first fixed roll of a discharge tension unit 24. The discharge tension unit 24 is furthermore equipped with a floating discharge roll 25 as a floating roll, which is arranged rotably via a floating discharge roll supporting arm 26 and pivotally with regard to a fixed discharge roll supporting arm 27 rigidly connected to the support bar 11. On the fixed discharge roll supporting arm 27 furthermore an outlet-side fixed discharge roll 28 is rotatably attached as a second fixed roll of the discharge tension unit 24.

It is discernible from FIG. 1 that the material web 4 in the form of the two conveyor belts 5, after emerging from the manipulation device 19, is placed in an S-shaped manner around the inlet-side fixed discharge roll 23, around the floating discharge roll 25 and around the outlet-side fixed discharge roll 28 and via a rotatable auxiliary roll 29, fixedly attached to the supporting frame 1, of a further guide sleeve 30 as well as by a routing unit 31 set up for the space-saving routing of the material web 4 discharged from the manipulation unit 19 by lateral to and fro guidance of the material web 4, is fed to a receiving roll 32 of the exemplary embodiment of the device according to the invention. The receiving roll 32 can be driven to rotate in both directions of rotation via a receiving roll motor 33 according to the dispenser roll 2.

Figure 2:
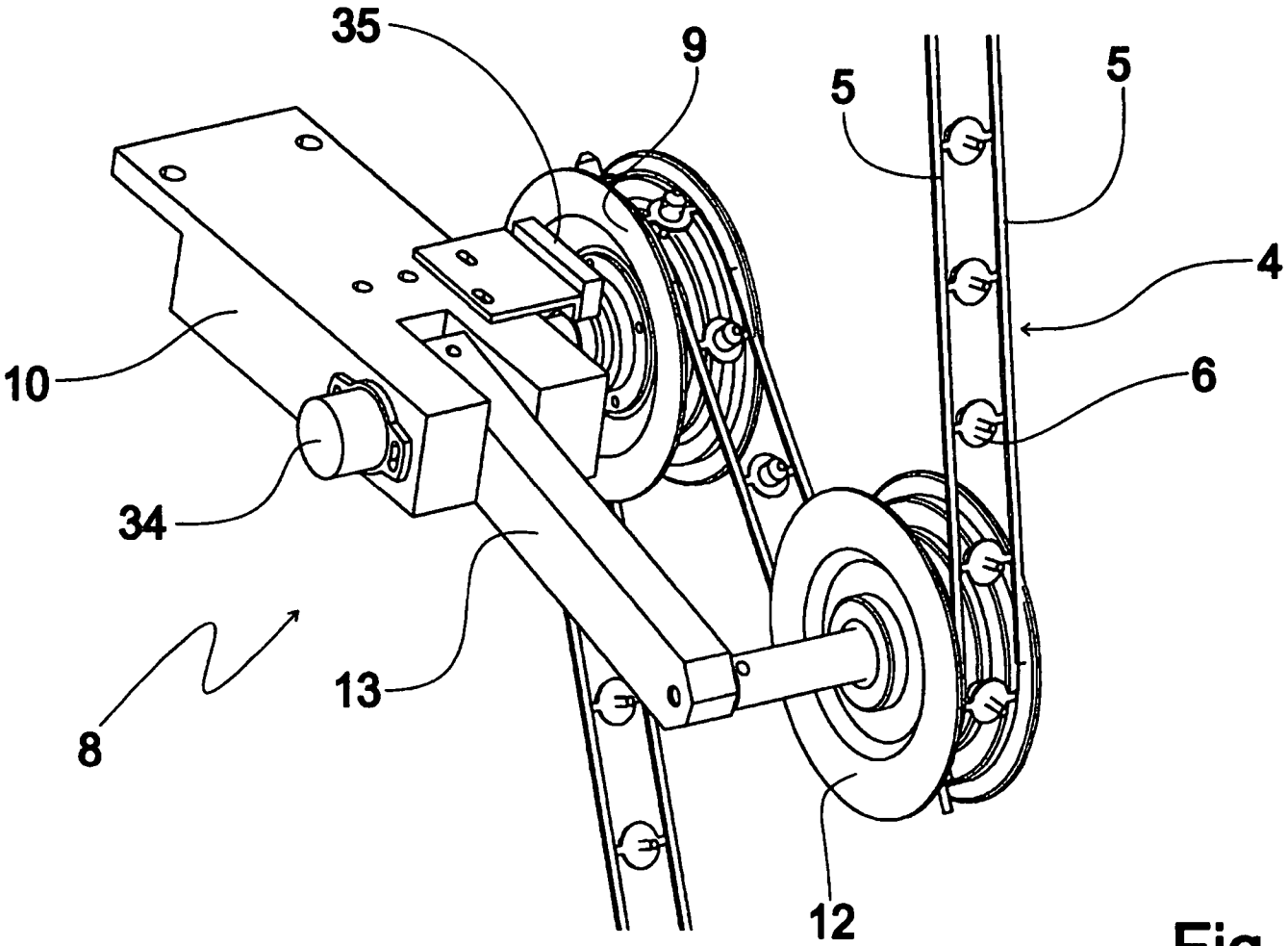
FIG. 2 is a perspective view of an exemplary embodiment of a feed tension unit of the device according to the invention according to FIG. 1.

FIG. 2 shows in a perspective view the inlet-side fixed feed roll 9 and the floating feed roll 12 of the feed tension unit 8 with the material web 4 fed through in an S-shaped manner. From FIG. 2 it is discernible that the floating feed roll supporting arm 13 is supported pivotably in the inlet fixed roll supporting arm 10, so that during the pivoting of the floating feed roll 12, the S-shaped wrapping of the inlet-side fixed feed roll 9 and the floating feed roll 12 is more or less marked, to equalize certain changes in the tensile stress exerted on the material web 4 with the gravitational force acting on the floating feed roll 12 as a restoring force.

Alternatively or additionally to the gravitational force, with a modification (not shown) of the exemplary embodiment explained it is provided that the or a further restoring force is exerted by a torsion spring acting on the floating feed roll supporting arm 13.

The feed tension unit 8 is furthermore equipped with a feed angle sensor 34 as an angle sensor, with which control signals assigned to the angular positions of the floating feed roll supporting arm 13 can be generated.

Furthermore, it is discernible from FIG. 2 that the inlet-side fixed feed roll 9 is coupled with a direction of rotation sensor 35, the output signals of which are assigned to the respective direction of rotation of the inlet-side fixed feed roll 9.

Figure 3:
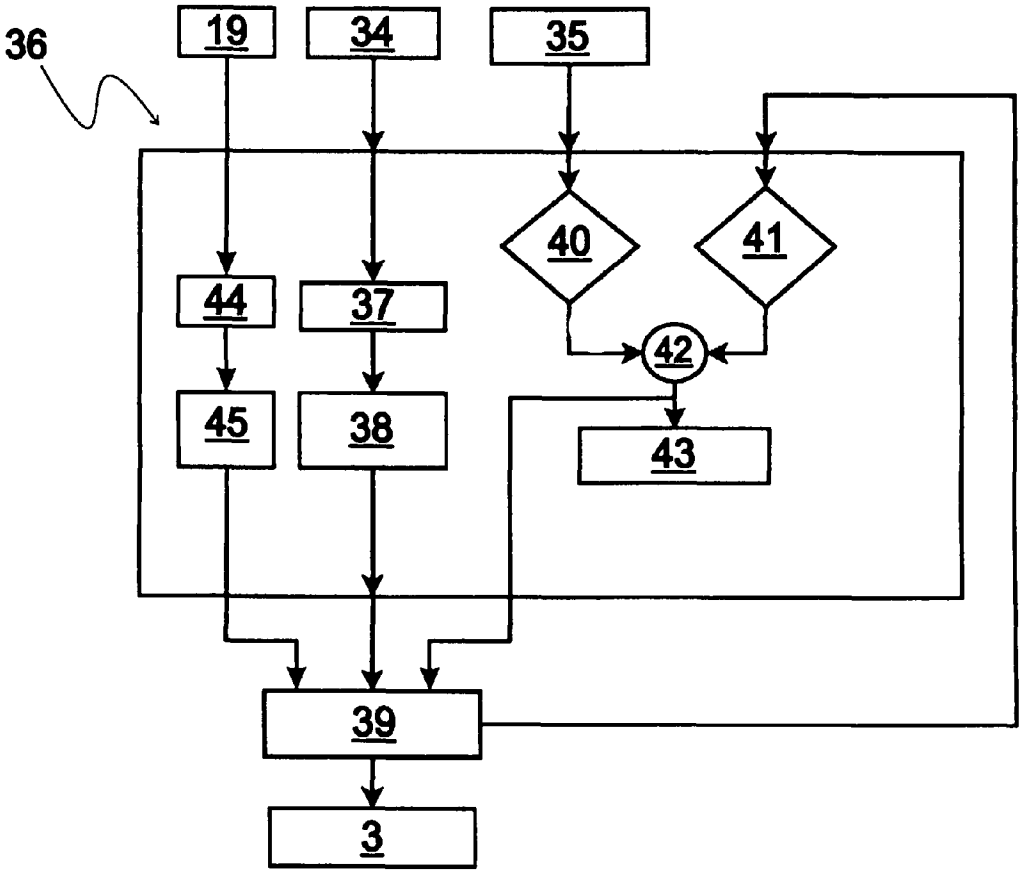
FIG. 3 is a block diagram of an exemplary embodiment of a control unit for a device according to the invention.

FIG. 3 shows in a block diagram an exemplary embodiment of a control unit 36 of a device according to the invention. The control unit 36 is in connection on the input side with the feed angle sensor 34 and the direction of rotation sensor 35. The output signals of the feed angle sensor 34 can be fed to an angle evaluation module 37, with which the current angular position of the floating feed roll supporting arm 13 can be converted into an input signal for a rotational control module 38.

With the rotational control module 38 of the control unit 36 a frequency converter 39 arranged upstream of the dispenser roll motor 3 can be controlled, in order when a reference angular position of the floating feed roll supporting arm 13 is exceeded as a first form of the deviation from a reference angular position to trigger an addition of material web 4 via the performance of a feed rotation of the dispenser roll 2 and/or when the same or a further reference angular position is fallen below as a second form of deviation from a reference angular position to trigger the dispenser roll motor 3 to rotate the dispenser roll 2 in a return direction opposite to the feed rotation to return material web 4 onto the dispenser roll 2.

In this manner it is ensured that in the event of deviation of the floating feed roll supporting arm 13 from the or a reference angular position by active feed or by active discharge the material web 4 is loaded within predetermined limits with an essentially constant tensile stress in order to guarantee a reliable use of the manipulation device 19 for example even in the case of rapid extensive movements.

It is further discernible from FIG. 3 that the direction of rotation sensor 35 is connected to a first direction of rotation discrimination module 40 and the frequency converter 39 to a second direction of rotation discrimination module 41. The direction of rotation discrimination modules 40, 41 are attached to an AND operator element 42, which then supplies an output signal for an error display module 43 and a STOP signal fed to the frequency converted 39 to switch off the control when the directions of rotation of the dispenser roll 2 and the inlet-side fixed feed roll 9 are contrarotating, which is indicative of an incorrect operation of the device according to the invention.

The control unit 36 furthermore has a counter module 44 connected to the manipulation unit 19, with which counter module the mounting elements 6 separated by the manipulation unit 19 from the conveyor belts 5 can be counted. The counter module 44 is connected to a parameter set selection module 45, which in turn is connected to the frequency converter 39. Depending on the counter reading stored in the counter module 44, the rotational speed of the dispenser roll 2 can be preset in at least two stages in order to take into account the decreasing level of the dispenser roll 2 with an effective discharge of the material web 4 from the dispenser roll 2 averaged over a longer period such that the dispenser roll 2 rotates relatively slowly with a still relatively high level and rotates more quickly with a relatively low level compared to a relatively high level.

In a further development of the device according to the invention explained above, it is provided that the discharge tension unit 24 is also equipped with a discharge angle sensor corresponding to the feed angle sensor 34 with respect to functionality and with a discharge direction of rotation sensor corresponding to the feed angle sensor 24 with regard to functionality for the outlet-side fixed discharge roll 28, which with the duplication of the elements of the control unit 36 explained above, lead to a corresponding control of the direction of rotation and the speed of the receiving roll 32, if the floating delivery roll supporting arm 36 deviates from the or a reference angular position.

Figure 4:
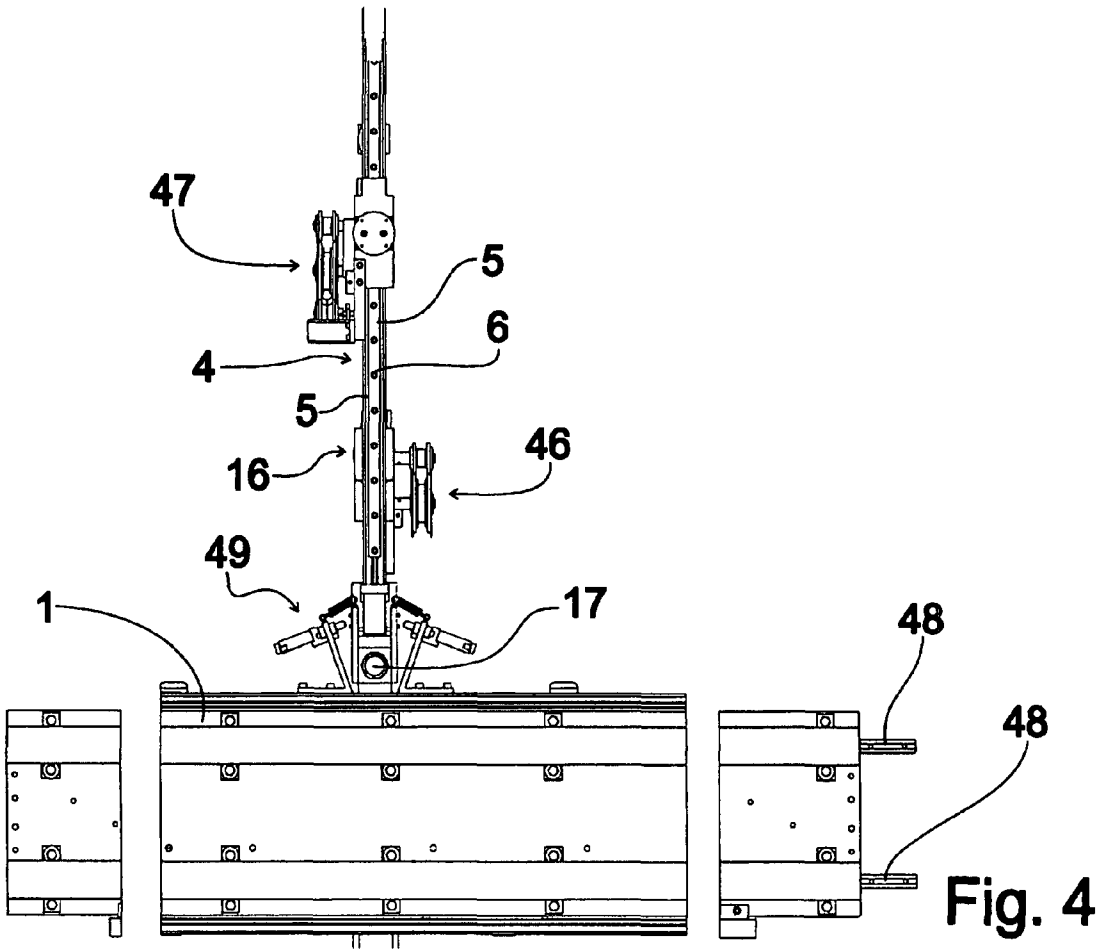
FIG. 4 is a plan view of a swivel arm with a device according to FIG. 1 that is supported in a slidable manner along rails.

FIG. 4 shows in a plan view the swivel arm 16 of the exemplary embodiment according to FIG. 1. It is discernible from FIG. 4 that a first manipulation device suspension 46 and a second manipulation device suspension 47 are attached to the swivel arm 16 in order, in addition to the manipulation device 19 shown in FIG. 1, to have a further manipulation device 19 by way of replacement and, as needed, to be able to store both manipulation devices 19 at a predetermined location in the event that they are not used. The representation according to FIG. 4 shows that the device according to the invention is supported on guide rails 48 so as to be slidable to and fro along a working stroke, in order to be able to use the material web 4, for example, in an assembly line at different locations.

As can be seen from FIG. 4, at the end of the swivel arm 16 facing towards the supporting frame 1, a lateral position detection unit 49 is arranged, which is explained in more detail below.

Figure 5:
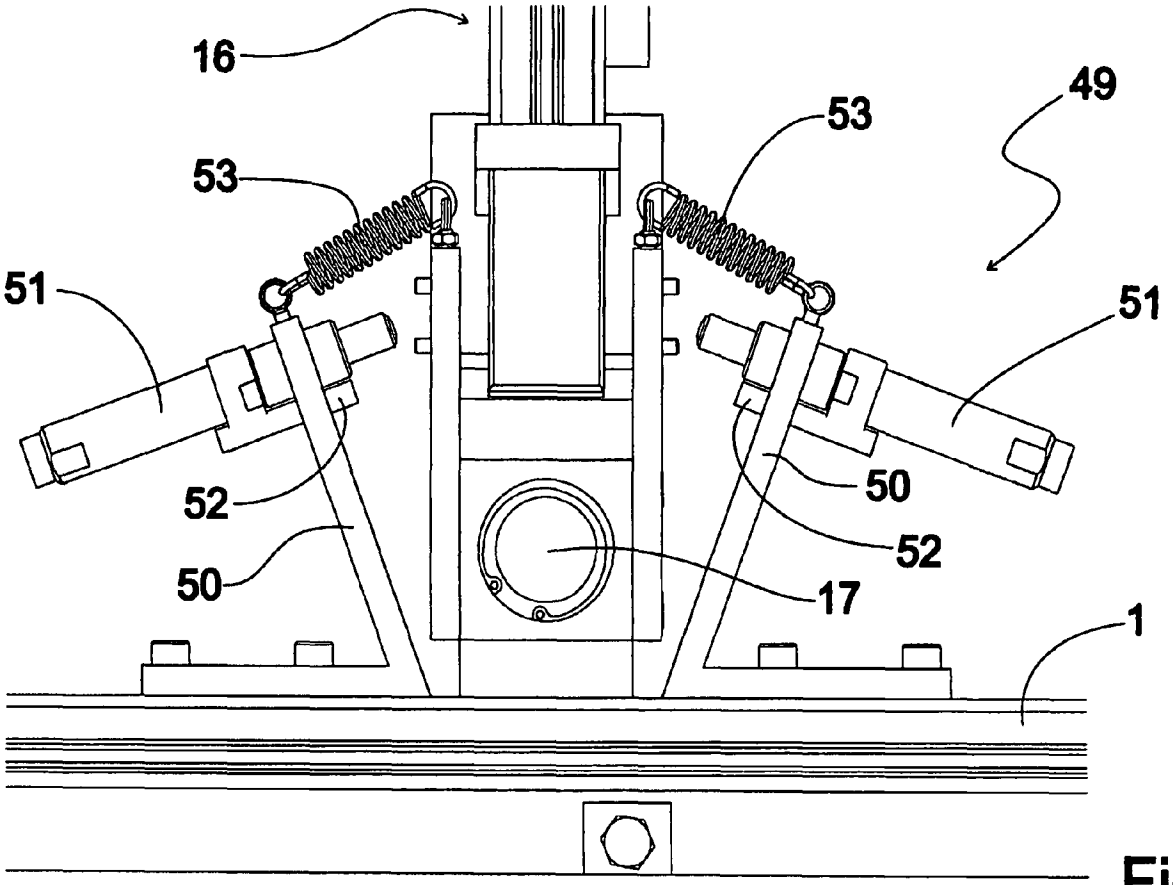
FIG. 5 is an enlarged representation compared to the representation according to FIG. 4 of the swivel arm in the attachment region with a supporting frame.

FIG. 5 shows the lateral position detection unit 49 in an enlarged plan view compared to the representation in FIG. 4. The lateral position detection unit 49 has brackets 50 attached on both sides of the swivel arm 16 to the supporting frame 1, on the ends of which facing away from the supporting frame 1 in each case a lateral stop damper 51 and an induction sensor 52 are attached. Furthermore, the ends of the bracket 50 facing away from the supporting frame 1 are mechanically connected via respectively one helical tension spring 53 to the supporting arm 16, which hold the supporting arm 16 essentially in a central position without exerting laterally acting forces.

When the swivel arm 16 approaches one of the induction sensors 52, however, from when a predetermined distance threshold value is fallen below, the respective induction sensor 52 emits an output signal to a control unit, not shown in FIG. 5, which causes the device according to the invention to be moved in the direction of the inductions sensor 52 emitting the output signal until the distance threshold value is again exceeded. The device according to the invention can thus be automatically moved very comfortably by a worker 20 over a working stroke stipulated by the length of the guide rails 48.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A device for feeding a quasi-endless material web to a manipulation device, said device comprising:

a freely movable manipulation device about which the material web is received;

a rotatable dispenser roll upon which the material web is received, said dispenser roll coupled to a dispenser roll motor, said dispenser roll motor operable to drive said dispenser roll in a first direction of rotation and in a second direction of rotation opposite said first direction of rotation; and a feed tension unit arranged between said dispenser roll and said manipulation device, said feed tension unit comprising:

at least two fixedly arranged fixed rolls;

at least one swivel-mounted floating roll;

an angle sensor responsive to an angular position of said floating roll; and a control unit connected to said angle sensor and said dispenser roll motor, said control unit operable responsive to a deviation by said floating roll from a reference angular position to operate said dispenser roll either in said first direction of rotation to feed the material web to said manipulation device or in said second direction of rotation to retract the material web from said manipulation device.

2. The device of claim 1, further comprising a discharge tension unit and a receiving roll, said receiving roll coupled to a receiving roll motor, said receiving roll motor operable to drive said receiving roll in a first direction of rotation and in a second direction of rotation opposite said first direction of rotation.

3. The device of claim 2, wherein said discharge tension unit (24) further comprises:

at least two fixedly arranged fixed rolls;

a swivel-mounted floating roll;

an angle sensor responsive to an angular position of said floating roll of said discharge tension unit, said angle sensor of said discharge tension unit connected to said control unit and said control unit operable responsive to a deviation by said floating roll of said discharge tension unit from a reference angular position to operate said receiving roll either in said first direction of rotation to retract the material web from said manipulation device or in said second direction of rotation to feed the material web to said manipulation device.

4. The device of claim 3, wherein at least one of said floating rolls of said discharge tension unit is attached to a floating roll supporting arm, said floating roll support arm pivotably attached to a fixed roll supporting arm bearing at least one said fixed roll of said discharge tension unit.

5. The device of claim 4, wherein said angle sensor of said discharge tension unit is mounted proximate said floating roll supporting arm facing towards said fixed roll supporting arm.

6. The device of claim 3, wherein said control unit includes a parameter set selection module operable to adjust a speed of at least one of said dispenser roll and said receiving roll may responsive to a fill level.

7. The device of claim 3, further comprising a swivel aim disposed between said feed tension unit and said discharge tension unit along which the material web is guided.

8. The device of claim 7, further comprising:

a swivel arm sensor arrangement responsive to an angular position of said swivel arm; and a displacement device connected to said swivel arm sensor arrangement, said displacement device operable to displace said dispenser roll, said receiving roll, said feed tension unit, said discharge tension unit, and said and manipulation device along a working stroke controlled by said pivot arm sensor arrangement.

9. The device of claim 1, wherein at least one of said floating rolls is attached to a floating roll supporting arm, said floating roll support arm pivotably attached to a fixed roll supporting arm bearing at least one said fixed roll.

10. The device of claim 9, wherein said angle sensor of said feed tension unit is mounted proximate said floating roll supporting arm facing towards said fixed roll supporting arm.

* * * * *